US006349731B1

(12) United States Patent
Schaaf et al.

(10) Patent No.: US 6,349,731 B1
(45) Date of Patent: Feb. 26, 2002

(54) WATER INLET SYSTEM FOR DISHWASHER

(75) Inventors: Demetrius J. Schaaf, St. Joseph; Eric C. Erwin, Benton Harbor, both of MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/514,086

(22) Filed: Feb. 28, 2000

(51) Int. Cl.[7] ..... A47L 15/42
(52) U.S. Cl. ..... 134/114; 134/200; 137/216.1
(58) Field of Search ..... 134/95.2, 99.2, 134/114, 186, 200; 137/216, 216.1, 843, 852

(56) References Cited

U.S. PATENT DOCUMENTS

| | | | | |
|---|---|---|---|---|
| 2,909,184 A | * | 10/1959 | Milroy et al. | 134/114 |
| 3,394,725 A | | 7/1968 | Macoicz | 137/216.1 |
| 3,439,688 A | | 4/1969 | Sholtes | 134/104 |
| 3,508,571 A | | 4/1970 | Dutcher et al. | 137/216 |
| 3,717,168 A | | 2/1973 | Yake | 137/216.1 |
| 3,821,961 A | * | 7/1974 | Schimke | 134/186 X |
| 3,971,540 A | * | 7/1976 | Johnson et al. | 134/186 X |
| 4,184,500 A | * | 1/1980 | Herbst | 134/114 |
| 4,657,036 A | | 4/1987 | Yake | 134/95 |
| 5,660,195 A | * | 8/1997 | Taylor, Jr. et al. | 134/95.2 X |
| 6,293,289 B1 | * | 9/2001 | Hapke et al. | 134/95.2 X |

FOREIGN PATENT DOCUMENTS

| | | | | |
|---|---|---|---|---|
| DE | 2152021 | * | 3/1972 | 134/114 |

* cited by examiner

*Primary Examiner*—Philip Coe
(74) *Attorney, Agent, or Firm*—Joel M. Van Winkle; Robert O. Rice; Thomas J. Roth

(57) ABSTRACT

A water inlet assembly for mounting adjacent an opening provided in a tub of an automatic dishwasher wherein the tub defines a cavity having a volume for washing dishes. The water inlet assembly includes a housing forming a venting chamber and having an outlet opening mounted in sealed relationship about the opening provided in the tub. The venting chamber has a vent opening which may be located above the outlet opening. The housing further includes an inlet nozzle for receiving wash liquid and a conduit for guiding liquid from the inlet nozzle to the venting chamber from which wash liquid can flow through the outlet opening into the tub. A water trap is formed into the housing and is located along the conduit. The conduit has a siphon opening located upstream of the water trap. A pressure actuated valve is positioned to block the passage of air from the tub cavity through the venting chamber and out the vent opening in a closed state and to allow the passage of air from the tub cavity through the venting chamber and out the vent opening in an open state. The pressure actuated valve moves from the closed to the open state in response to an excess of air pressure in the tub cavity.

10 Claims, 5 Drawing Sheets

WATER INLET SYSTEM FOR DISHWASHER

BACKGROUND OF THE INVENTION

1. Field of the Invention

This invention relates to a water inlet system for a dishwasher and more particularly, a water inlet for a dishwasher which provides for water inlet into the dishwasher and air flow out of the dishwasher to relieve pressure which may occur within the dishwasher.

2. Description of the Related Art

Modern dishwashers include a tub having an access opening and a door for the access opening. The tub supports one or more racks adapted to hold dishes. A pump and liquid spray system is provided for recirculating liquid within the tub. By spraying wash liquid through the tub onto soiled dishes, the dishes are cleaned.

Automatic dishwashers are arranged to carry on a plurality of operations in sequence. The series of operations is generally referred to as a "cycle". A typical automatic dishwasher cycle comprises in sequence a series of operations which may include a first wash, a drain, a second wash, a second drain, a first rinse, a third drain and a final, second rinse followed by a final drain.

At the beginning of each wash and rinse operation, water is supplied into the dishwasher tub. This may be accomplished by controlling a water valve, fluidly interconnected with a water supply, to selectively open and close. A water inlet system must be provided whereby water is directed from the water valve, into the dishwasher tub. A typical water inlet system includes a water inlet device mounted to a side wall of the dishwasher tub which is interconnected with a fill tube which extends from the water valve. The water inlet device serves to direct the water into the dishwasher tub.

Plumbing codes generally require an air gap in association with the water inlet system of a dishwasher so that if a negative pressure is produced in the water supply line, contaminants will not be drawn into the water supply line. Accordingly, water inlet devices for use with dishwashers are configured to provide an air gap which is sometimes referred to as a siphon or vacuum break.

In some dishwashers, the water inlet system has added functionality in that it provides an air inlet path for satisfying various drying, ventilation and pressure surge requirements. In these systems, air may be allowed to pass into and out of the dishwasher tub through the water inlet system.

SUMMARY OF THE INVENTION

The present invention is directed to water inlet assembly for mounting adjacent an opening provided in a tub of an automatic dishwasher wherein the tub defines a cavity having a volume for washing dishes. The water inlet assembly includes a housing forming a venting chamber and having an outlet opening mounted in sealed relationship about the opening provided in the tub. The venting chamber is provided with a vent opening. The housing further includes an inlet nozzle for receiving wash liquid and a conduit for guiding liquid from the inlet nozzle to the venting chamber from which wash liquid can flow through the outlet opening into the tub. A water trap is formed into the housing and is located along the conduit. The conduit has a siphon opening located upstream of the water trap. A pressure actuated valve is positioned to block the passage of air from the tub cavity through the venting chamber and out the vent opening in a closed state and to allow the passage of air from the tub cavity through the venting chamber and out the vent opening in an open state. The pressure actuated valve moves from the closed to the open state in response to a rise or a determined excess of air pressure in the tub cavity.

DESCRIPTION OF THE PREFERRED EMBODIMENT

Figure 1:
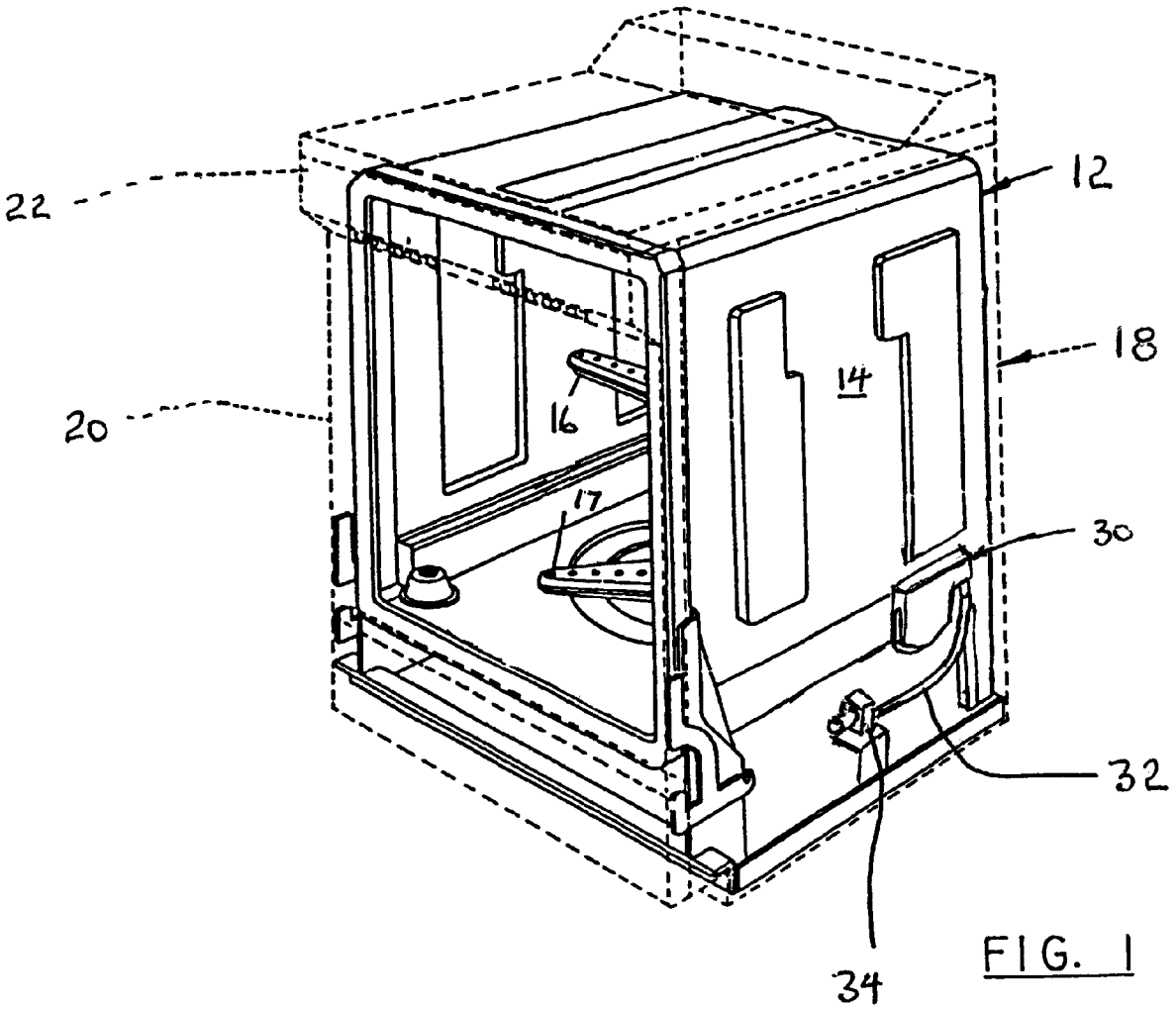
FIG. 1 is a perspective view of an exemplary dishwasher tub with the assembly of the resent invention mounted thereon and with a surrounding cabinet and door indicated in broken lines.
Figure 2:
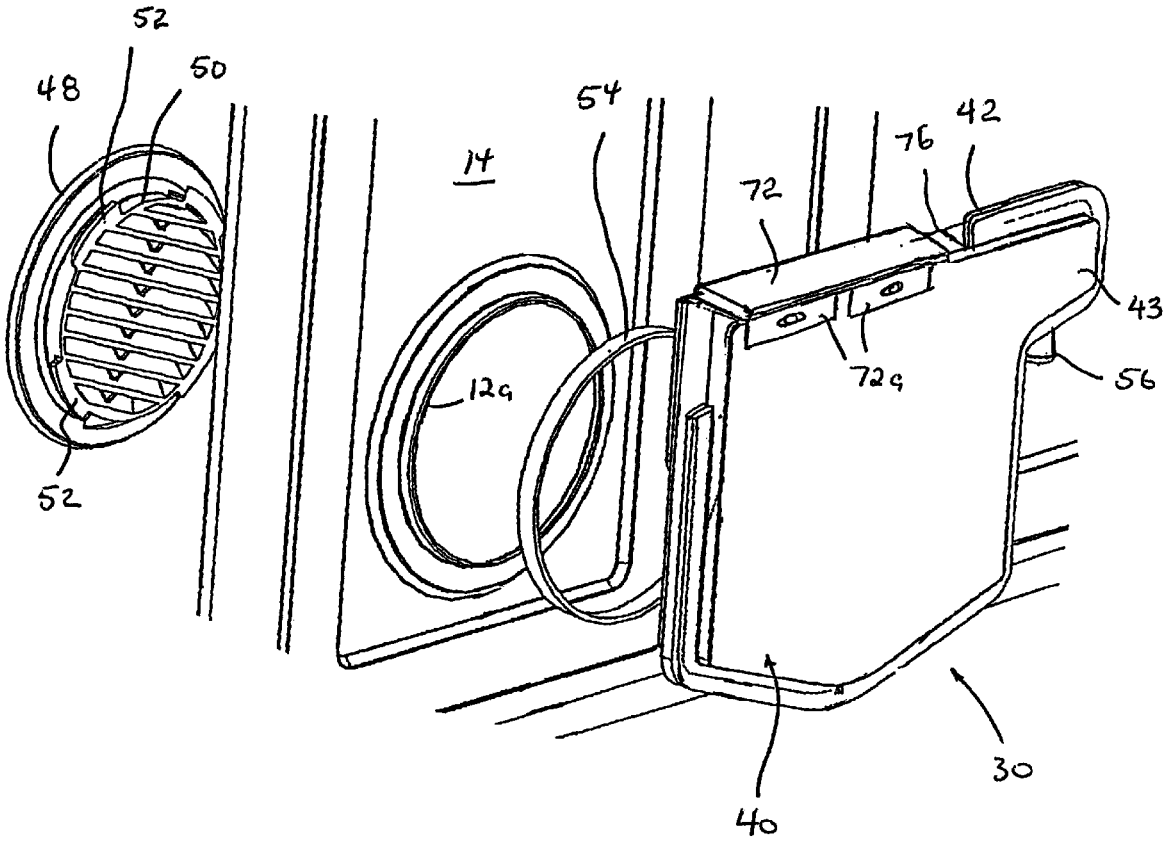
FIG. 2 is an exploded, perspective view of the water inlet assembly of the present invention showing the tub and louvered cap.
Figure 3:
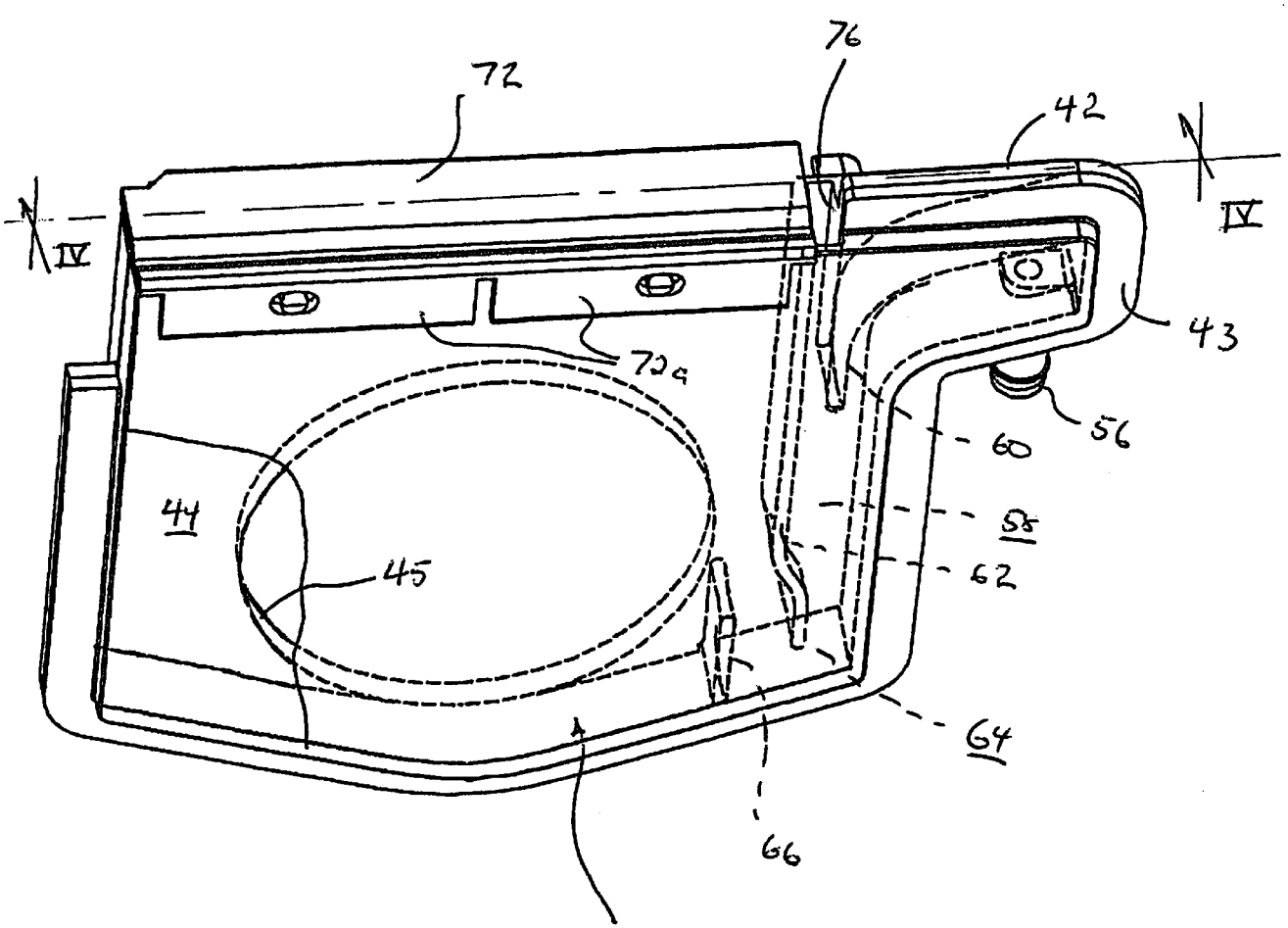
FIG. 3 is a perspective view of water inlet assembly showing internal details in broken lines and showing the flapper valve in a closed position.
Figure 4:
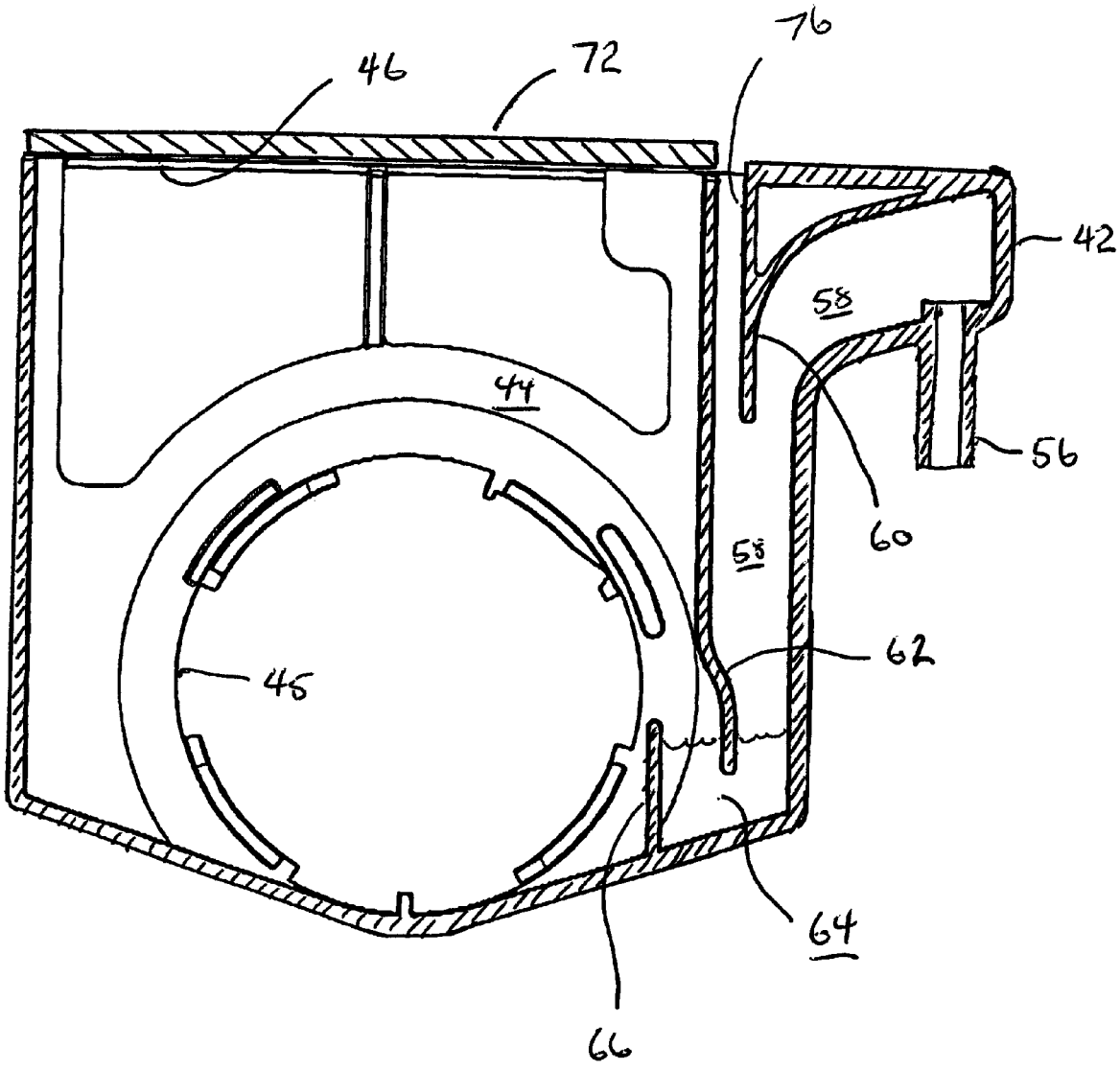
FIG. 4 is a sectional view taken along line IV—IV of FIG. 3.

Referring first to FIG. 1, there is shown in this Figure an exemplary automatic dishwasher for home use. The dishwasher comprises a tub 12 having a side wall 14. The tube supports upper and lower tableware racks (not shown) for supporting dishes. The dishwasher is provided with a pump system (not shown) for recirculating water within the tub 12 and draining water therefrom. A pair of spray arms are shown at 16 and 17. The exterior cabinet of the dishwasher is illustrated in broken lines and generally indicated at 18. The cabinet 18 includes a front opening door 20. The upper end of the door terminates in a console 22 containing the timer and various dishwasher controls (not shown).

The water inlet assembly is indicated at 30 and is shown mounted to a lower rear area of the side wall 14 of the tub 12. An inlet tube 32, extends from a water valve 34 which is fluidly connected to a water supply line which supplies water under pressure. The valve 34 is controlled in a conventional way to open and close so as to permit water to flow through the inlet tube 32 to the water inlet assembly 30.

Turning now to FIGS. 2–5, details of the water inlet assembly 30 can be understood. The water inlet assembly includes a main housing 40 formed by base member 42 and a back member 43 which may be connected using known joining techniques—such as hot plate welding or otherwise. The housing forms a venting chamber or cavity 44 having an outlet opening 45 and an open top for forming a vent opening 46.

The housing 40 mounts to the tub 12 adjacent an opening 12*a* provided in the side wall 14 of the tub 12. The opening 12*a* and the outlet opening 45 have relatively large diameters such that both the inlet water and air may readily pass through the openings. The outlet opening 45 is mounted in sealed relationship about the opening 12*a* provided in the tub. A louvered cap 48 is positioned on the inside of the tub 12 and includes a flange 50 which passes through the opening 12*a*. The flange has a plurality of cam lock tabs 52 for engaging the periphery of the outlet opening 45 in the housing 40 such that the tub side wall 14 is captured between the louvered cap 48 and the housing 40. A gasket 54 is compressed between the housing 40 and the tub wall 14 to provide a water tight seal to the tub 12.

The housing 40 includes an integral inlet nozzle 56 for attachment to the flexible inlet tube 32. Water flowing into the water inlet assembly 30 passes through the inlet nozzle 56 into a conduit 58 formed by an internal ribs 60 and 62 provided within the housing 40. At the lower portion of the conduit 58, an S-trap or water trap 64 is provided. The S-trap 64 is created through the use of a dam rib 66 which traps and holds water in the lower portion of the conduit 58. Water flowing through the S-trap 64 passes into the venting chamber 44 and is then directed to flow into the tub 12 through the outlet opening 45, the opening 12*a* in the tub 46 and the louvered cap 48.

As discussed above, it is desirable to allow air flow through the water inlet assembly in certain circumstances. This is particularly true in conditions where rapid pressure build up occurs within the tub 12, such as when the dishwasher operation is interrupted to add an item for cleaning. When the door 20 is opened, the tub's volume of heated, moist air is replaced by colder air from the ambient environment. When the door 20 is reclosed, the newly introduce air is rapidly heated causing it to rapidly expand in a manner that is referred to as "surge" or "surging".

A path of escape out of the tub 12 for this rapidly expanding gas is provided through the vent chamber 44 and the vent opening 46. As air expands within the tub, air may flow through the louvered cap 48, through the tub opening 12*a* and through the vent opening 46. However, except for the relatively rare occurrences of surge, it is desirable to preclude the flow of hot, moist air out through the vent opening 46. Since a dishwasher is mounted within the cabinetry of a kitchen, hot and moist air exiting form the vent opening can cause undesirable damage to the kitchen cabinetry. Moreover, an open vent opening allows sound to exit the dishwasher during operation.

Accordingly, a pressure relief or actuated valve is provided on the vent opening 46 for closing the opening 46 of the vent chamber 44 during normal operation. The pressure relief or actuated valve may be any well known pressure actuated valve including a diaphragm, umbrella and flapper valves known in the art. In the disclosed embodiment, the pressure relief or actuated valve is an elastomeric flap 72 which is attached to the housing 40 along its edge 72*a* and in its relaxed state lies horizontally atop the housing overlying the vent opening 46 sealing in noise and moisture. In this way, the above describe cabinet damage will not occur.

Figure 5:
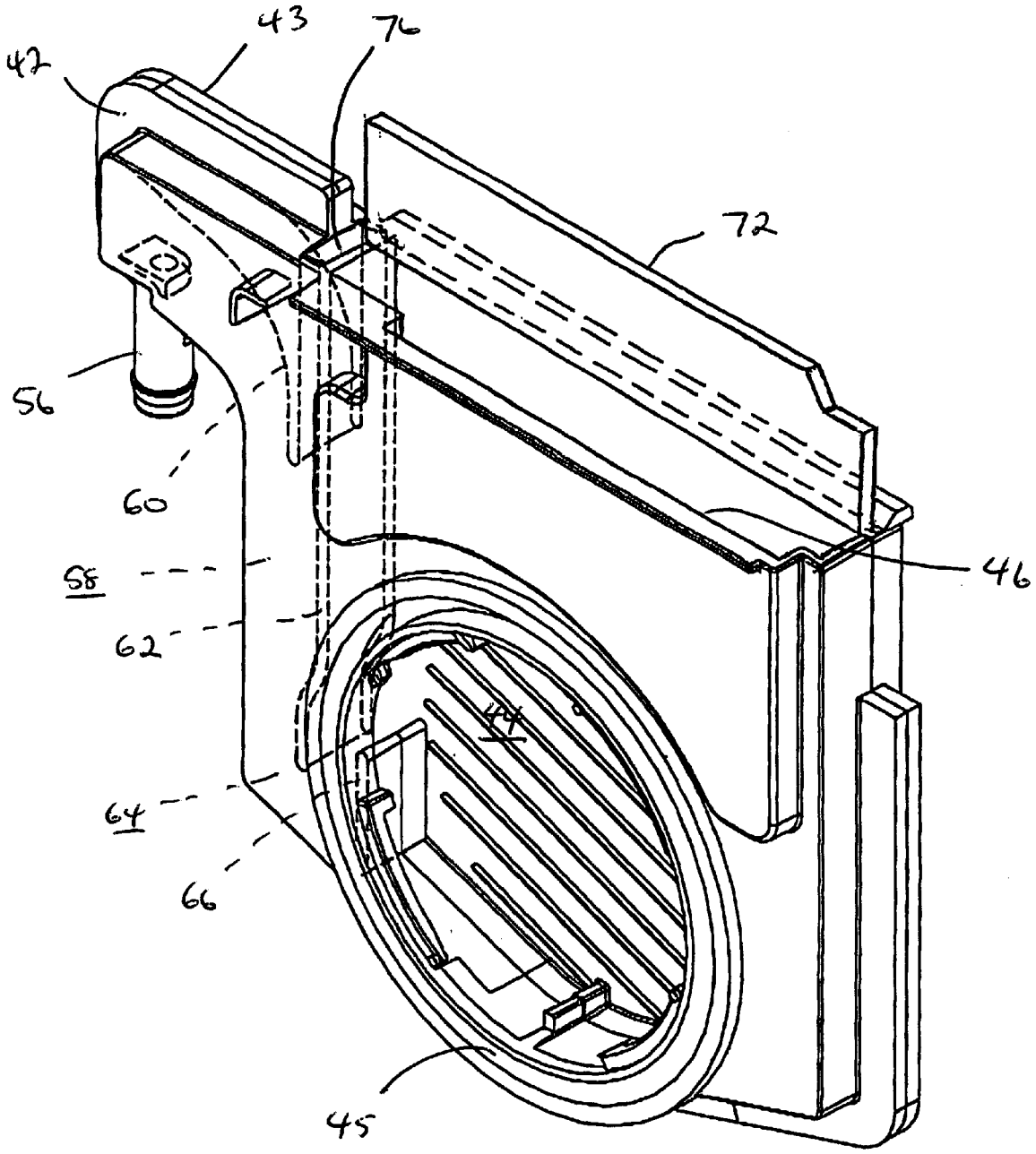
FIG. 5 is a perspective view of water inlet assembly showing internal details in broken lines and showing the flapper valve in an open position.

Pressure from expanding air and steam above a designated threshold, however, as shown in FIG. 5 causes an upward flexing of the edge 72*a* of the elastomeric flap 72 away from the open top 70 allowing passage of air and steam therethrough. The weight and elasticity of the flap 72 and the area of the vent opening 46 may be adjusted so as to provide an arbitrary pressure threshold for opening and the necessary clear opening when the flap 72 does open.

To provide a siphon or vacuum break, a siphon opening 76 is provided along the conduit 58 formed into the housing 40 such that the conduit 58 is open to atmosphere upstream from the water trap 64. If negative pressure occurs in the water supply line, air is drawn through the vent opening 76 rather than having fluid from the trap 64 and moisture and air from the interior of the tub 12 drawn into the water supply system.

While the present invention has been described with reference to the above described embodiments, those of skill in the art will recognize that changes may be made thereto without departing from the scope of the invention as set forth in the appended claims. For example, the vent chamber 44 and conduit 58 may be formed from separate parts and interconnected. The pressure relieve valve could be constructed in many different ways. The housing 40 could be attached to the tub in a number of known ways including through the use of separate threaded fasteners. The water trap could be provided by forming an S-shaped conduit arrangement. The vent opening 46 could be configured in a different shape and size from the shape and size disclosed in the preferred embodiment.

Accordingly, the present invention is not intended to be limited to merely the invention shown and described in the drawings and above written description. Rather, the present invention is set forth in the appended claims.

We claim:

1. A water inlet assembly for mounting adjacent an opening provided in a tub of an automatic dishwasher wherein the tub defines a cavity having a volume for washing dishes, the water inlet assembly comprising:

a housing forming a venting chamber having an outlet opening mounted in sealed relationship about the opening provided in the tub, the venting chamber further having a vent opening;

a conduit extending from the venting chamber and having an inlet nozzle for receiving wash liquid wherein the conduit guides liquid from the inlet nozzle to the venting chamber from which wash liquid can flow through the outlet opening into the tub and wherein a water trap is located along the conduit, a pressure actuated valve positioned to block the passage of air from the tub cavity to pass through the venting chamber and out the vent opening in a closed state and to allow the passage of air from the tub cavity through the venting chamber and out the vent opening in an open state, the pressure actuated valve moving from the closed to the open state in response to an excess of air pressure in the tub cavity.

2. The water inlet assembly according to claim 1, further wherein the conduit includes a siphon opening located upstream of the water trap.

3. The water inlet assembly according to claim 1, further wherein the conduit and water trap are formed as part of the housing.

4. The water inlet assembly according to claim 1, further wherein the pressure actuated valve comprises an elastomeric flap connected to the housing and positioned to block the flow of air through the vent opening.

5. The water inlet assembly according to claim 1, further wherein the housing is formed from a base member and a back member that are welded together.

6. The water inlet assembly according to claim 5, further wherein the conduit is formed by internal ribs of the base member joined to the back member and wherein the water trap is formed at the lower portion of the conduit by an internal dam rib extending from the base member.

7. A water inlet assembly for mounting adjacent an opening provided in a tub of an automatic dishwasher wherein the tub defines a cavity having a volume for washing dishes, the water inlet assembly comprising:

a housing forming a venting chamber having an outlet opening mounted in sealed relationship about the opening provided in the tub, the venting chamber further having a vent opening, the housing further having an inlet nozzle for receiving wash liquid and a conduit for guiding liquid from the inlet nozzle to the venting chamber from which wash liquid can flow through the outlet opening into the tub, a water trap located along the conduit, the conduit having a siphon opening located upstream of the water trap, a pressure actuated valve positioned to block the passage of air from the tub cavity through the venting chamber and out the vent opening in a closed state and to allow the passage of air from the tub cavity through the venting chamber and out the vent opening in an open state, the pressure actuated valve moving from the closed to the open state in response to an excess of air pressure in the tub cavity.

8. The water inlet assembly according to claim 7, further wherein the housing is formed from a base member and a back member that are welded together.

9. The water inlet assembly according to claim 7, further wherein the conduit is formed by internal ribs of the base member joined to the back member and wherein the water trap is formed at the lower portion of the conduit by an internal dam rib extending from the base member.

10. The water inlet assembly according to claim 7, further wherein the pressure actuated valve comprises an elastomeric flap connected to the housing and positioned to block the flow of air through the vent opening.

* * * * *

UNITED STATES PATENT AND TRADEMARK OFFICE

CERTIFICATE OF CORRECTION

PATENT NO. : 6,349,731 B1
DATED : February 26, 2002
INVENTOR(S) : Demetrius J. Schaaf and Eric C. Erwin It is certified that error appears in the above-identified patent and that said Letters Patent is hereby corrected as shown below:

Title page,
Item [75], Inventors, should read -- Demetrius J. Schaaf, Eric C. Irwin --

Signed and Sealed this

Third Day of September, 2002

*Attest:*

*Attesting Officer*

JAMES E. ROGAN
*Director of the United States Patent and Trademark Office*